United States Patent [19]

Ichikawa et al.

[11] Patent Number: 4,975,957

[45] Date of Patent: Dec. 4, 1990

[54] CHARACTER VOICE COMMUNICATION SYSTEM

[75] Inventors: Akira Ichikawa, Musashino; Yoshiaki Asakawa, Kawasaki; Shoichi Takeda, Saitama; Nobuo Hataoka, Kanagawa, all of Japan

[73] Assignee: Hitachi, Ltd., Tokyo, Japan

[21] Appl. No.: 343,892

[22] Filed: Apr. 24, 1989

Related U.S. Application Data

[63] Continuation of Ser. No. 857,990, May 1, 1986, abandoned.

[30] Foreign Application Priority Data

May 2, 1985 [JP] Japan ..... 60-93611

[51] Int. Cl.[5] ..... G10L 7/02; G10L 7/08; G10L 5/04

[52] U.S. Cl. ..... 381/36; 381/43; 381/52

[58] Field of Search ..... 381/36–45, 381/51–53; 364/513.5; 379/88–89

[56] References Cited

U.S. PATENT DOCUMENTS

| | | | |
|---|---|---|---|
| 4,301,329 | 11/1981 | Taguchi | 381/37 |
| 4,516,259 | 5/1985 | Yato et al. | 381/36 |
| 4,624,008 | 11/1986 | Vensko et al. | 381/43 |
| 4,661,915 | 4/1987 | Ott | 364/513.5 |
| 4,689,817 | 8/1987 | Kroon | 381/52 |
| 4,692,941 | 9/1987 | Jacks et al. | 381/52 |
| 4,707,858 | 11/1987 | Fette | 381/43 |
| 4,741,037 | 4/1988 | Goldstern | 381/36 |
| 4,799,261 | 1/1989 | Lin et al. | 364/513.5 |

OTHER PUBLICATIONS

Rebolledo et al., "A Multirate Voice Digitizer Based Upon Vector Quantization", IEEE Trans. Comm., vol. COM-30, No. 4, Apr. 1982, pp. 721–727.

Groner, "The Telephone—the Ultimate Terminal", Telephony, 6/4/84, pp. 34–40.

Roucos, "Segment Quantization for Very-Low-Rate Speech Coding", IEEE ICASSP 82, pp. 1565–1658.

Oyama, "A Stochastic Model of Excitation Source for Linear Prediction Speech Analysis-Synthesis", IEEE ICASSP 85, pp. 25.2.1–25.2.4.

Ichikawa et al. "A Speech Coding Method using Thinned Out Residual" IEEE ICASSP 85.

Atal et al., "A New Model of LPC Excitation for Producing Natural-Sounding Speech at Low Bit Rates", IEEE ICASSP 82, pp. 614–617.

Ichikana et al., "Conceptual System Design for Continuous Speech Recognition LSI", IEEE ICASSP 81, pp. 386–389.

Fujisaki et al., "Analysis of Voice Fundamental Frequency Contours for Declarative Sentences in Japanese", J. Acoust. Soc. Jpn. (E) 5, 4 (1984), pp. 233–242.

*Primary Examiner*—Gary V. Harkcom
*Assistant Examiner*—John A. Merecki
*Attorney, Agent, or Firm*—Antonelli, Terry, Stout & Kraus

[57] ABSTRACT

A character voice communication system including high efficiency voice coding system for encoding and transmitting speech information at a high efficiency and a voice character input/output system for converting speech information into character information or receiving character information and transmitting speech or character information are organically integrated. A speech analyzer and a speech synthesizer are shared by both the voice coding and the voice character input-/output systems. Communication apparatus is also provided which allows mutual conversion between speech signals and character codes.

8 Claims, 8 Drawing Sheets

| | | 1 | 2 | 3 | | | n-1 | n |
|---|---|---|---|---|---|---|---|---|
| (a) | ① | $a_{11}$ | $a_{12}$ | $a_{13}$ | | | $a_{1n-1}$ | $a_{1n}$ |
| | ② | $a_{21}$ | $a_{22}$ | $a_{23}$ | | | | $a_{2n}$ |
| | ③ | $a_{31}$ | $a_{32}$ | $a_{33}$ | | | | $a_{3n}$ |
| (i) | ① | $i_{11}$ | $i_{12}$ | $i_{13}$ | | | | |
| | ② | $i_{21}$ | $i_{22}$ | $i_{23}$ | | | | |
| | ③ | $i_{31}$ | $i_{32}$ | $i_{33}$ | | | | |
| ≈ | ≈ | ≈ | ≈ | ≈ | ≈ | ≈ | ≈ | ≈ |
| (o) | ① | $o_{11}$ | $o_{12}$ | $o_{13}$ | | | $o_{1n-1}$ | $o_{1n}$ |
| | ② | $o_{21}$ | $o_{22}$ | $o_{23}$ | | | $o_{2n-1}$ | $o_{2n}$ |
| | ③ | $o_{31}$ | $o_{32}$ | $o_{33}$ | | | $o_{3n-1}$ | $o_{3n}$ |
| ≈ | ≈ | ≈ | ≈ | ≈ | ≈ | ≈ | ≈ | ≈ |
| (byo) | ① | $byo_{11}$ | – | – | | | – | – |
| | ② | $byo_{21}$ | – | – | | | – | – |
| | ③ | $byo_{31}$ | – | – | | | – | $byo_{3n}$ |

| | | | |
|---|---|---|---|
| $o_{11}$ | A | P | W |

CHARACTER VOICE COMMUNICATION SYSTEM

This application is a continuation of application Ser. No. 857,990, filed May 1, 1986, now abandoned.

BACKGROUND OF THE INVENTION

With the development of digitization of a communication line and character input/output technique such as word processing, realization of communication apparatus which allows mutual conversion between the characters and voices has been demanded. One approach thereto is described in Japanese Patent Publication No. 59-19358 entitled "Voice Transmission System" coinvented by one of inventors of the present invention. In the disclosed system, a telex machine is combined with a voice typewriter and speech synthesis by rule. However, it is a strong demand in the voice transmission to communicate the personal tone of a speaker. In the disclosed system, it is difficult to realize the character communication. On the other hand, with the development of the word processing technique, a system which uses a word processor as a communication terminal and an integrated voice data terminal (IVDT) which combines a telephone with the communication terminal have been proposed. However, although the voice and character data are incorporated in one terminal, information thereof is independently handled and organic coupling of the information is not attained.

SUMMARY OF THE INVENTION

It is an object of the present invention to provide a communication system which organically combines voice data communication with character data communication.

In order to achieve the above object, in accordance with the present invention, a voice word processing system having a speech-synthesis by rule with a voice typewriter and a high efficiency speech coding system (speech information compressed transmission) are organically integrated, where a speech analysis unit and a speech synthesis unit are shared.

More specifically, in the high efficiency speech coding transmission system, speech information is separated into spectrum envelope information and fine spectrum information, and each of them is appropriately compression-encoded. The spectrum envelope information has linguistic information (phonological information), and the fine spectrum information has accent (pitch accent or stress accent) and intonation of the voice and personal information of the speaker.

In the speech-synthesis by rule, it is necessary to synthesize accent and intonation as well as phoneme information in order for a character string to be converted to a voice with a high quality. For example, it is necessary that the synthesis unit use a system which can independently combine the linguistic information (phonological information) and the accent and intonation such as "désert" and "desért". On the other hand, the voice typewriter is primarily designed to extract the linguistic or phonological information from the speech and convert it to the character information and it is necessary to use analysis method which eliminates personal characteristic as much as possible. The accent and intonation information may be auxiliary used to delimit a word in continuous speech and determine a sentence style.

In this manner, through the use of a technique to separate the speech information into spectrum envelope information and the fine spectrum information and recombine them, three types of systems, namely of high efficiency voice coding transmission, speech synthesis by rule and voice typewriter can be organically combined.

Thus, when the personal characteristic or nuance included in the voice is to be transmitted, the high efficiency voice coding system is used, and when the voice input is to be represented by characters or when a sentence represented by characters is to be voiced or to be transmitted in the form of character, the character code transmission function is used.

DESCRIPTION OF THE PREFERRED EMBODIMENTS

Figure 1:
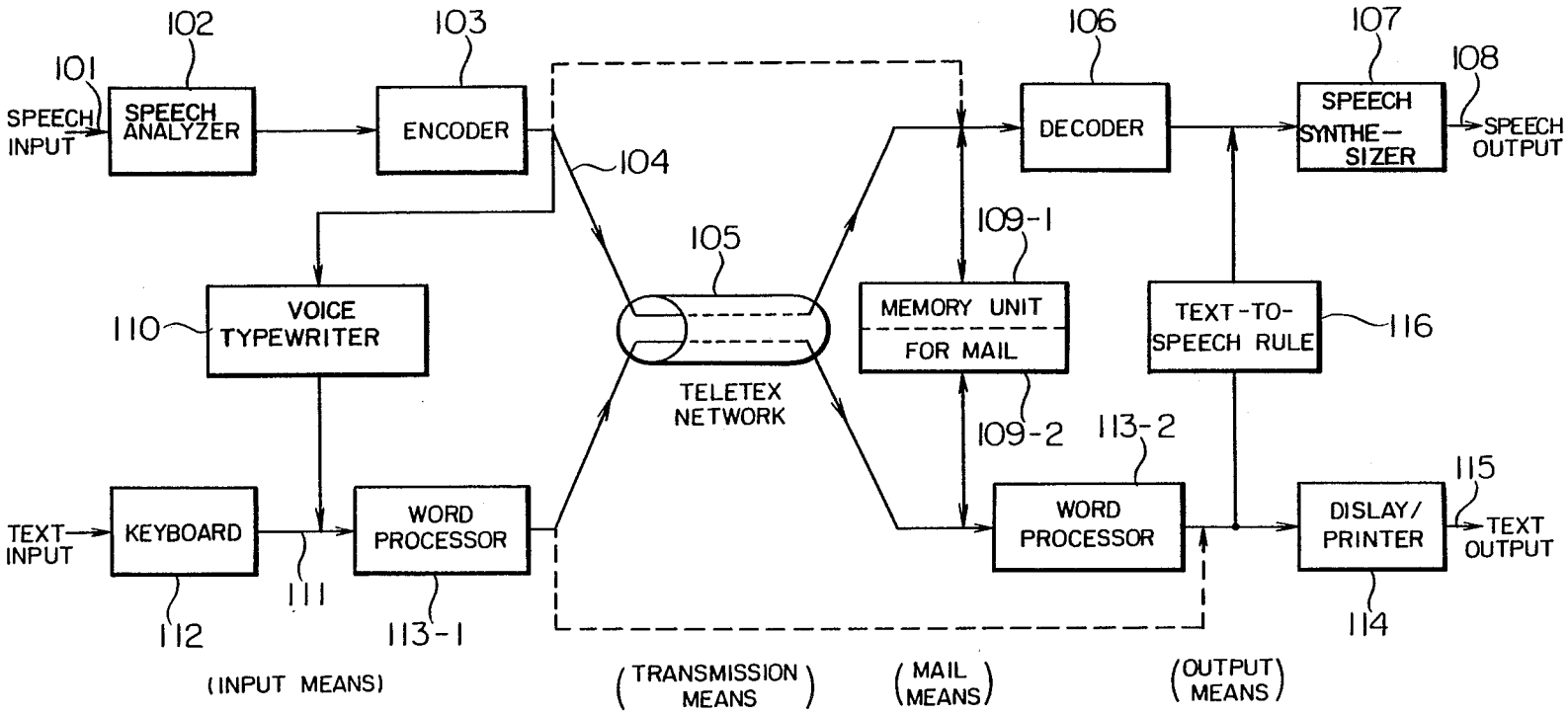
FIG. 1 is a block diagram of a communication system in accordance with the present invention.

FIG. 1 shows a functional block diagram of a terminal in which a word processor function and a teletex function are combined with high efficiency voice coding transmission, speech synthesis by rule and voice typewriter. Transmission apparatus need not be limited to a teletex network but other apparatus may be used.

The functional operations are first explained. When the terminal shown in FIG. 1 functions as a voice compression transmission terminal, a speech input 101 is separated to spectrum envelope information and fine spectrum information by a speech analyzer 102, the information is compressed by an encoder 103 and converted to transmission codes 104 and sent out to a transmission line 105 through a line interface. The received information is synthesized into a speech waveform by a speech synthesizer 107 through a decoder 106 and outputted as a voice (speech output) 108. If the compressed information is temporarily stored in a memory 109-1, it functions as a voice mail.

When the terminal shown in FIG. 1 is used as a voice typewriter 110, the speech is recognized by the spectrum information and converted to a Kana (character) code string 111. The encoder 103 may be omitted and the output of the speech analyzer 102 may be directly used. In this step, the converted Kana (character) code string can be handled as a signal of the same level as that of a key-entered Kana (character) code sequence from a keyboard 112. Accordingly, functions of the word processor such as Kana (character)-Kanji (chinese-character) conversion can be used. The Kana-Kanji converted data may be displayed on a display (114, 115) or transmitted as character information by using the teletex function 105. A mail function which uses the character information may be provided.

It is frequently troublesome to look through a large amount of character code document information on a display. When important information is to be visually checked or a chart is to be observed, they may be displayed on the display 114 but much sentence information may be in many cases listened by voice. In this case, the character information string is converted to the spectrum envelope information and the fine spectrum information, and they are converted to voice waveforms by the speech synthesis unit (decoder for speech compression transmission) 107 and can be outputted (108) as voice.

Within the terminal, broken lines are connected because it is necessary at times to use the terminal as a voice memory or word processor.

In this manner, an economical construction of apparatus is attained by sharing various processing functions 102 and 107 to thereby organically convert characters to voice or vice versa.

Figure 2:
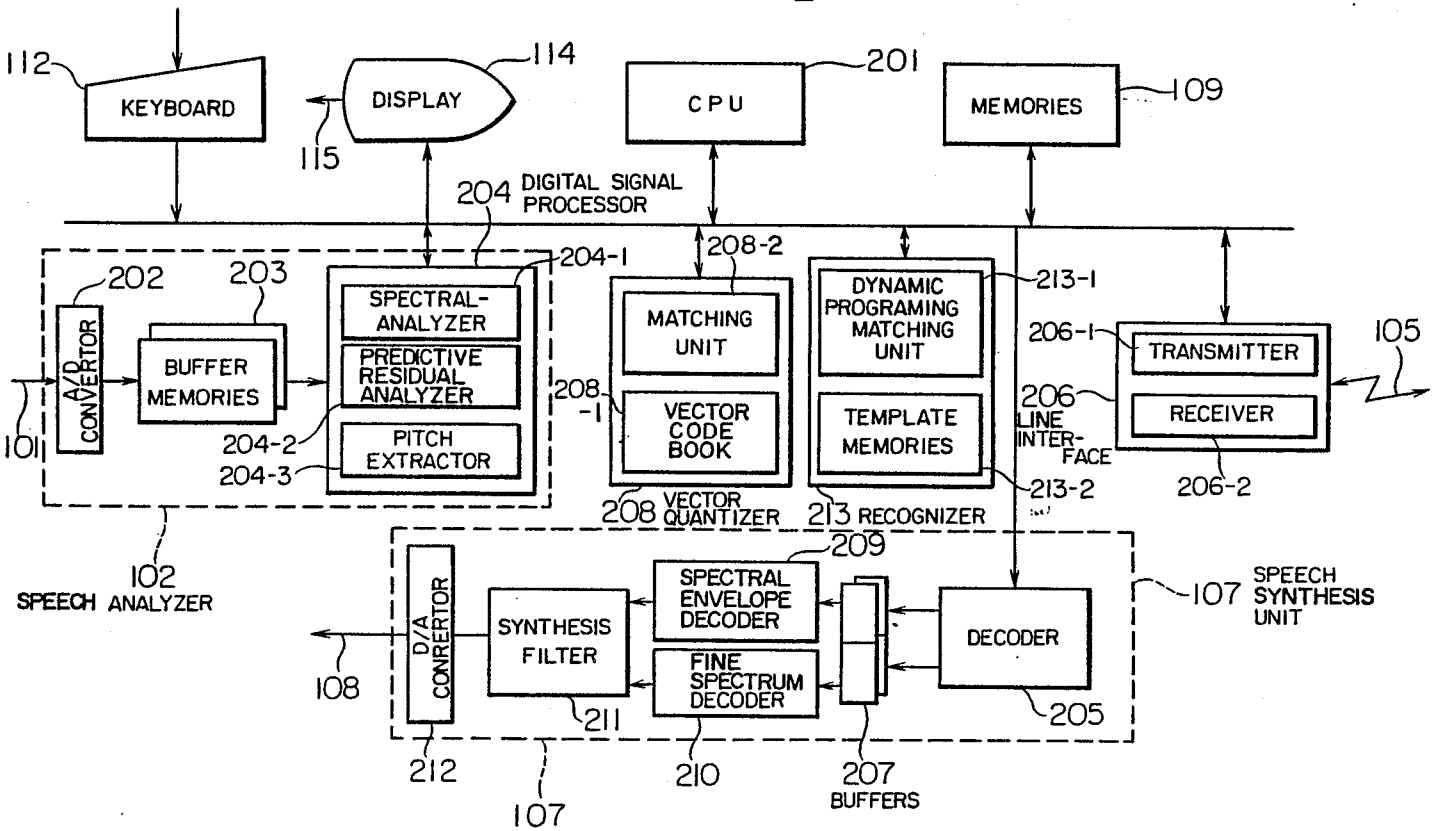
FIG. 2 shows a configuration of an embodiment of the present invention.

FIG. 2 shows a configuration of one embodiment of the present invention.

Functions of major unit are explained first. In the present system, necessary functions are attained by organic combination of those units.

A speech analyzer 102 analyzes speech input and comprises an A/D converter 202, a memory 203 for temporarily buffering the speech input and a digital signal processor (DSP) 204 for processing signals. The DSP 204 extracts the spectrum envelope information by a speech input spectrum analyzer (by linear prediction) 204-1, extracts the fine spectrum information by a predictive residual extractor 204-2 and extracts a pitch (204-3).

The speech input 101 is digitized by an A/D converter 202 and it is sent to an input buffer 203 which is of dual buffer structure which can hold the next speech input without interruption during coding of a predetermined length of speech.

A vector quantizer 208 comprises a vector code book 208-1 which contains various tables and a matching unit 208-2 which compares an input data with the tables to output a code of a matching table. An item to be quantized is determined by selecting a necessary code book by an instruction from a main control unit 201.

A recognizer 213 comprises a template memory 213-2 and a dynamic programming (DP) matching unit 213-1. The recognizer 213 is used for matching a pattern having a time structure.

A speech synthesizer unit 107 synthesizes voice from codes which are received by a receiver 206-2 of a line interface 206 as a high efficiency voice coding transmission code or a code sequence produced to convert characters to voice by a synthesis by rule program of the processor 201.

The codes are separated to speech spectrum information and voice source information by a decoder 205 and they are stored in designated areas of a buffer 207 of the speech synthesizer 107. The data is converted to a filter control signal of a synthesis filter 211 and an input signal by a spectrum envelope decoder 209 and a fine spectrum decoder 210 and they are supplied to the synthesis filter 211. They are synthesized to a speech by the synthesis filter 211, converted to an analog signal by a D/A converter 212 which produces an output 108.

Procedures for attaining the functions shown in FIG. 2 by the arrangement of FIG. 2 are explained in further detail.

For the high efficiency voice coding transmission, the speech input 101 is analyzed into the spectrum envelope information (linear prediction parameters) by the spectrum envelope analyzer 204-1 which carries out the linear prediction analysis, timed in the buffer memory 203 and supplied to the fine spectrum analyzer 204-2 (linear prediction inverse filter). The spectrum envelope information is quantized by the vector quantizer 208 and it is sent to the transmitter 206-1. The output of the fine spectrum analyzer 204-2 is also quantized by the vector quantizer 208 and it is sent to the transmitter 206-1 where it is merged to the quantized spectrum envelope information and transmitted.

For the voice typewriter function, the spectrum envelope information is converted to a character sequence candidate by the voice typewriter recognizer 213 and it is sent to the processor 201 where it is used as an input to the word processor function of the processor 201.

A character code sequence may be directly entered from the keyboard 112 without entering the speech information. The process and the result of the word processing may be displayed (115) on the display 114 as required. The prepared text data is stored in the memory 109. When it is to be transmitted to other terminal as the character data, it is sent from the processor 201 to the communication line 105 (teletex network) through the transmitter 206-1.

The processing of the data sent from other terminal is now explained.

It is not known whether the data sent from another terminal is voice compressed data or character code data. Because the subsequent processing differs depending on the type of data, it is necessary to discriminate the data. The compressed transmission data discriminated by predetermined processing is decoded into the synthesis parameters by the spectrum envelope decoder 209 and the fine spectrum decoder 210, and they are synthesized into the speech waveform by the speech synthesizer 211 and outputted as the synthesized speech 108.

When the text data in the memory 109 is to be outputted by voice, it is converted to speech synthesis parameters by the synthesis by rule program of the processor 201 and sent to the speech synthesis parameter buffer 207 and converted to the synthesized speech 108 by the speech synthesizer 211 through the decoders 209 and 210. The speech synthesis parameter buffer 207 functions to keep the real time of the synthesizer and absorb time variation of the synthesis by rule parameter generation. It may be arranged between the decoders 209 and 210 and the synthesizer 211.

The character data sent from another terminal is displayed (115) on the display 114 through the processor 201.

When the terminal is to be used as a mail, the character data or voice data are held in the memory 109 for a desired time period.

An embodiment in which one speech analyzer is used for both the high efficiency coding transmission and the speech recognition is explained.

In the past, the speech analysis of the high efficiency voice coding unit and the speech analysis of the speech recognition unit (which is used for voice typewriting function to convert the voice to a character string, the character string may be transmitted, and for entering control codes for the terminal) have been independently developed, or a portion of the linear prediction technique developed for the former was modified for use for the latter, and the condition of analysis or the formats of resulting information are different, or only a portion of information is utilized. Thus, they cannot be used for both analyses and the resulting information is not fully utilized by both analyses.

In the present invention, in order to allow sharing of the speech analyzer by both units, the high efficiency voice coding output is corrected by using knowledge of voice and matching to a difference pattern. The output of the speech analyzer of the high efficiency voice coding system includes the spectrum envelope information (for example, linear prediction coefficient or PARCOR coefficient), the fine spectrum information (sound source waveform information) (for example, prediction residual waveform), power of sound source waveform, pitch frequency or period of sound source (including presence or absence of periodicity). They are compared with the vector code books so that they are encoded to the vector codes. The information is encoded by the high efficiency voice coding system (to be described later) and then it is transmitted.

The speech recognizer determines format and pitch information based on the output information. This is very effective to improve performance of phones recognition. It has been widely known that the format value and the variation thereof in time are very important information to determine the phones. It has also been known from the synthesis experiment that the falling or raising pattern of pitch frequency in time is effective to distinguish similar voiceless consonant and voiced consonant (for example, k and g, t and d or p and b) and there is very little case where they are directly used for the recognition. In the present invention, by taking the advantage of a vector quantization method for analysis and coding, a plurality of candidates for the formant frequency and the pitch frequency corresponding to the vector code are extracted and represented in a table so that extraction time is saved and unstability of extraction is avoided.

By utilizing the spectrum information, format information and pitch information, the recognition ability is significantly improved over prior art systems which use only the spectrum information.

An embodiment which integrates the high efficiency speech coding system of the present invention and the speech recognition system is explained.

Figure 3:
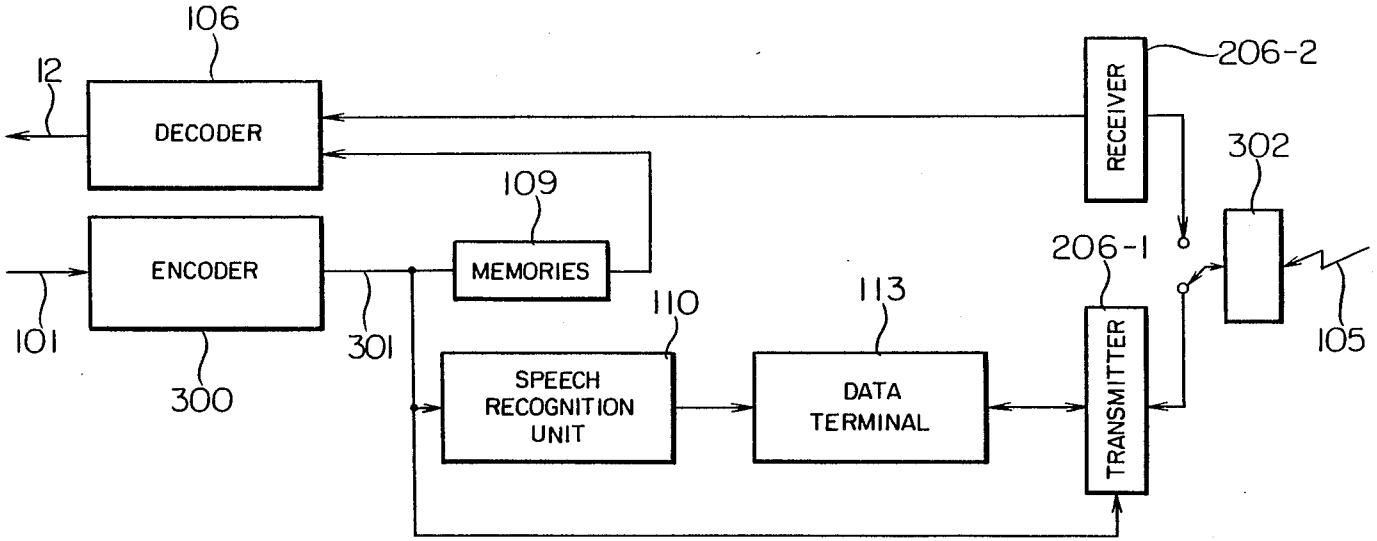
FIG. 3 shows an embodiment which integrates high efficiency voice coding unit and a speech recognition unit.

FIG. 3 illustrates processing of a communication terminal which has a high efficiency speech coding unit and a speech recognition unit. It is shown by blocks to facilitate understanding of the functions. The speech input 101 is encoded by the high efficiency speech encoding unit 300 and the encoded speech signal 301 from the unit 300 is sent out to the line 105 through an encoded speech interface 302 when it is to be transmitted, and applied to the speech recognition unit 110 and also stored in the memory 109 when it is to be used as a speech recognition input to the data terminal. When the recognition result is to be checked, the content of the memory 109 is transferred to the high frequency voice decoding unit 106. Because it is high efficiency encoded, the memory capacity required may be small. The recognition result is sent to the word processor 113 where it is handled in the same manner as a normal keyed-in data, and when it is to be transmitted as data, it is sent out to the line 105 through the transmitter 206-1 and the line interface 302.

The voice coding unit 300 will be explained later. An embodiment of the speech recognition unit 110 is shown in FIG. 4.

Figure 4:
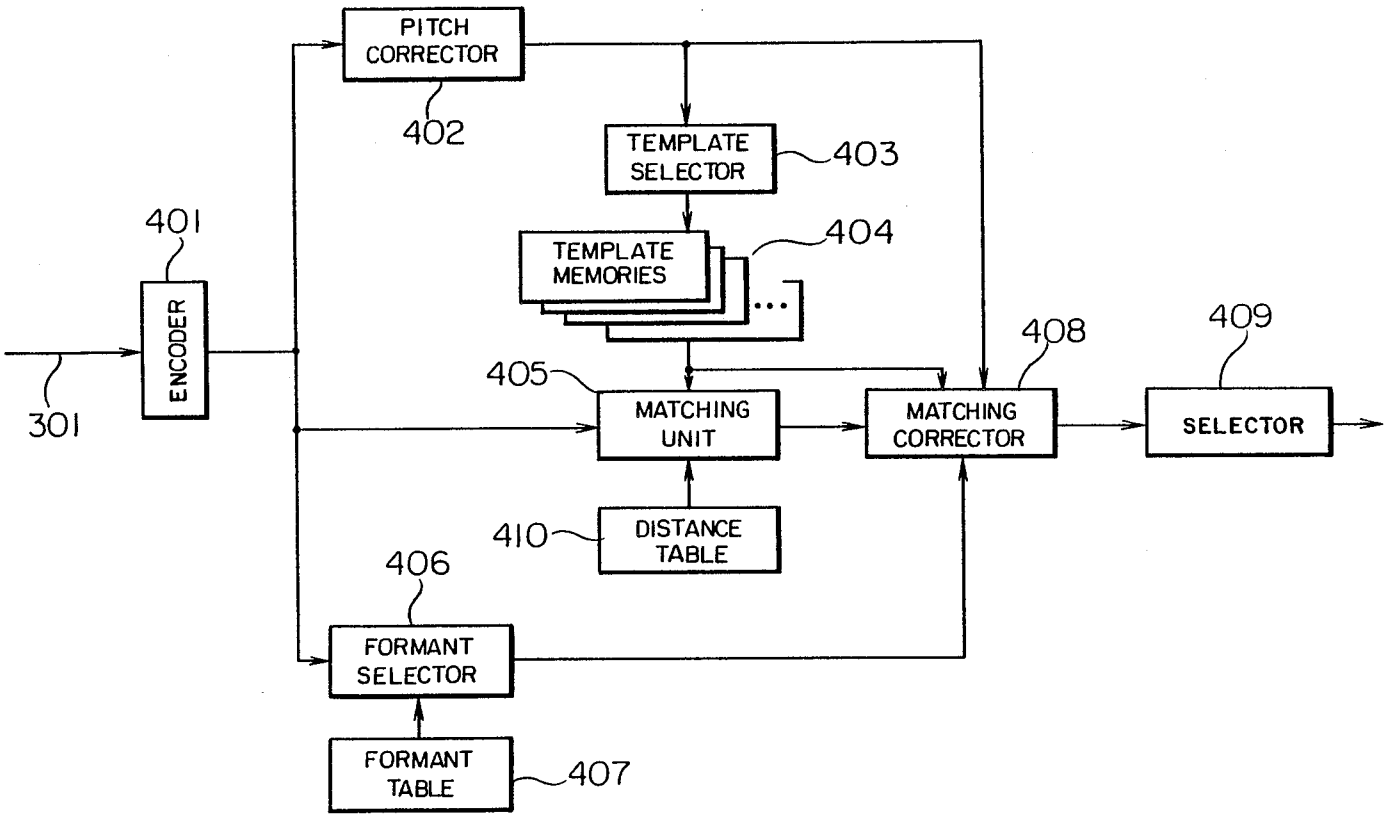
FIG. 4 shows a speech recognition unit.

FIG. 4 shows a block diagram of the speech recognition unit 110. The encoded speech signal 301 encoded by the voice coding unit 103 is decomposed into codes by an encoder 401 (which uses the function of 208 of FIG. 2 although it is not essential). Pitch information is sent to a pitch corrector 402 and other information is sent to a matching unit 405 and a formant selector 406.

In the pitch extraction method of the present embodiment, the pitch information is extracted from those having pitch range specified by using the spectrum information to be described later. Accordingly, the pitch information is extracted more stably than in a conventional pitch extraction method. However, since misextraction may occur by an environmental noise, the extracted pitch information is compared with preceding and succeeding pitch information by the pitch corrector 402 and if discontinuity which does not occur phonetically, external insertion is made based on the immediately preceding pitch information. A simplest correction is to substitute by the immediately preceding pitch information. The pitch information thus corrected is sent to a template selector 403 (in the recognizer 213 of FIG. 2) and a matching corrector 408 (processed by the main processor 201 of FIG. 2).

The speech recognition unit of the present embodiment comprises the recognizer 213 and the controlling software of the main processor 201 and is continuous speech recognition system for an unspecified speaker using a multi-template method. The template memory 404 (213-2 in FIG. 2) includes a plurality of templates for each recognition category. Each template is related to a speaker group of similar tones. Depending on the input pitch information, one or more template sets are selected to improve the recognition performance and reduce the amount of matching processing. The template selector 403 has a function to determine an average value of the input pitch information to detect an average tone of the speaker. The average pitch $\bar{f}_t$ is given by $$\bar{f}_t = \alpha \cdot \bar{f}_{t-1} + (1-\alpha) \cdot f_t \quad (1)$$

where $f_t$ is the input pitch frequency and $\alpha$ is a time constant smaller than 1, which is used to determine a range for averaging effectively.

The template memory 404 (213-2 in FIG. 2) contains the templates in a form of time serial spectrum code. Instantaneous distance is calculated by referring the speech input spectrum code and a distance table 410 (213 in FIG. 2), and the input pattern is continuously compared with the templates by a continuous dynamic programming (DP) matching method and candidates are produced. The continuous DP matching method may be a known method such as that disclosed in "Conceptual System Design of a Continuous Speech Recognition LSI" by A. Ichikawa et al, Proceedings of ICASSP 81, 1981.

The formant selector 406 is constructed by the software in the main processor 201 and takes out a plurality of candidates for first to third formant frequencies from the formant table by using the input spectrum code as a key. It is usually difficult to precisely analyze and extract the formant value on real time. In the present system, the formant value corresponding to the spectrum code is precisely determined and it is registered in the table. However, since the spectrum may be temporarily disturbed by environmental noise, the second and third formant candidates are prepared in the formant table and a most appropriate one is selected by taking the continuity into account. For example, a predicted formant value $\overline{F}_{n,t}$ is given from the formant table 407 as $$\overline{F}_{n,t}=a_1F_{n,t-1}+a_2\cdot F_{n,t-2}$$

where $F_{n,t}$ is an n-th order formant value corresponding to the input spectrum code and $a_1$ and $a_1$ are experimentarily determined prediction coefficients. The candidate which is closest to $\overline{F}_{n,t}$ is selected as $F_{n,t}$. If the candidate is spaced from $\overline{F}_{n,t}$ by more than a predetermined distance, it is considered that it is due to the disturbance by the noise and $\overline{F}_{n,t}$ is selected as $F_{n,t}$. In this manner, continuous and stable formant frequency is produced. Depending on whether the pitch information is periodic or nonperiodic, the control is selected to produce the accurate formant frequency.

Each template in the template memory 404 contains not only the time sequence of spectrum code but also information on whether the pitch frequency is rising or falling and whether the n-th formant is rising or falling. The matching corrector 408 detects the output of the pitch corrector 402 and/or the formant selector 406 and the matching of those information to correct the output of the matching unit 405. It is constructed by the software in the main processor 201. For example, the corrected matching value D' is given by $$D'=W_P\cdot W_F\cdot D$$

where D is a distance and $W_P$ and $W_F$ are factors of the pitch and formant. The matching value D' is set to 1.5 when $W_P$ and $W_F$ are of opposite polarities and 1.0 in other cases. (When the matching degree is given not by the distance but by correlation or analogy, the weighting is opposite. The weighting differs depending on the nature of measurement.)

The corrected matching values are compared by a selector 409 so that a correct recognition result is obtained.

In accordance with the present invention, the speech analysis and the encoding which are common to the high efficiency voice coding system are attained. Thus, in the terminal having both functions, the analysis unit and the encoding unit may be common and a compact and economic apparatus can be provided.

An embodiment in which speech synthesis apparatus for reproducing voice from speech data and speech synthesis apparatus for synthesizing voice from character data are common is now explained.

In the past, the high efficiency transmission synthesizer which utilizes the speech output and the synthesizer for synthesis by rule for synthesizing desired voice have been independently developed, or the synthesizer developed for the former is used as it is for the latter as is done in the well-known PARCOR system. The analyzer which can be used for both purposes and provide high quality of speech output has not been developed.

In the present invention, the above object is achieved by providing apparatus for generating a code sequence from an input character string, in which the code sequence is necessary for hierarchy vector quantization by residual (HVQR) (to be described later) system.

An embodiment thereof is explained below. Various proposals have been made for a unit which estimates pronounciation or accent from an input character string and it does not constitute an essential part of the present invention. Accordingly, the explanation thereof is omitted. In the following description, it is therefore assumed that a pitch frequency pattern for intonation due to the pronounciation sequence or accent information has already been generated. In the present embodiment, the HVQR system is based on LPC system parameters. In the present embodiment, the spectrum parameter is vector-quantized based on the LPC coefficient or PARCOR coefficient, and the sound source information includes residual waveform, pitch frequency and residual amplitude of the sound source waveform in a coded form. When other coding parameters are combined with the synthesis by rule of the present invention, the parameters which fit thereto are selected.

Figure 5:
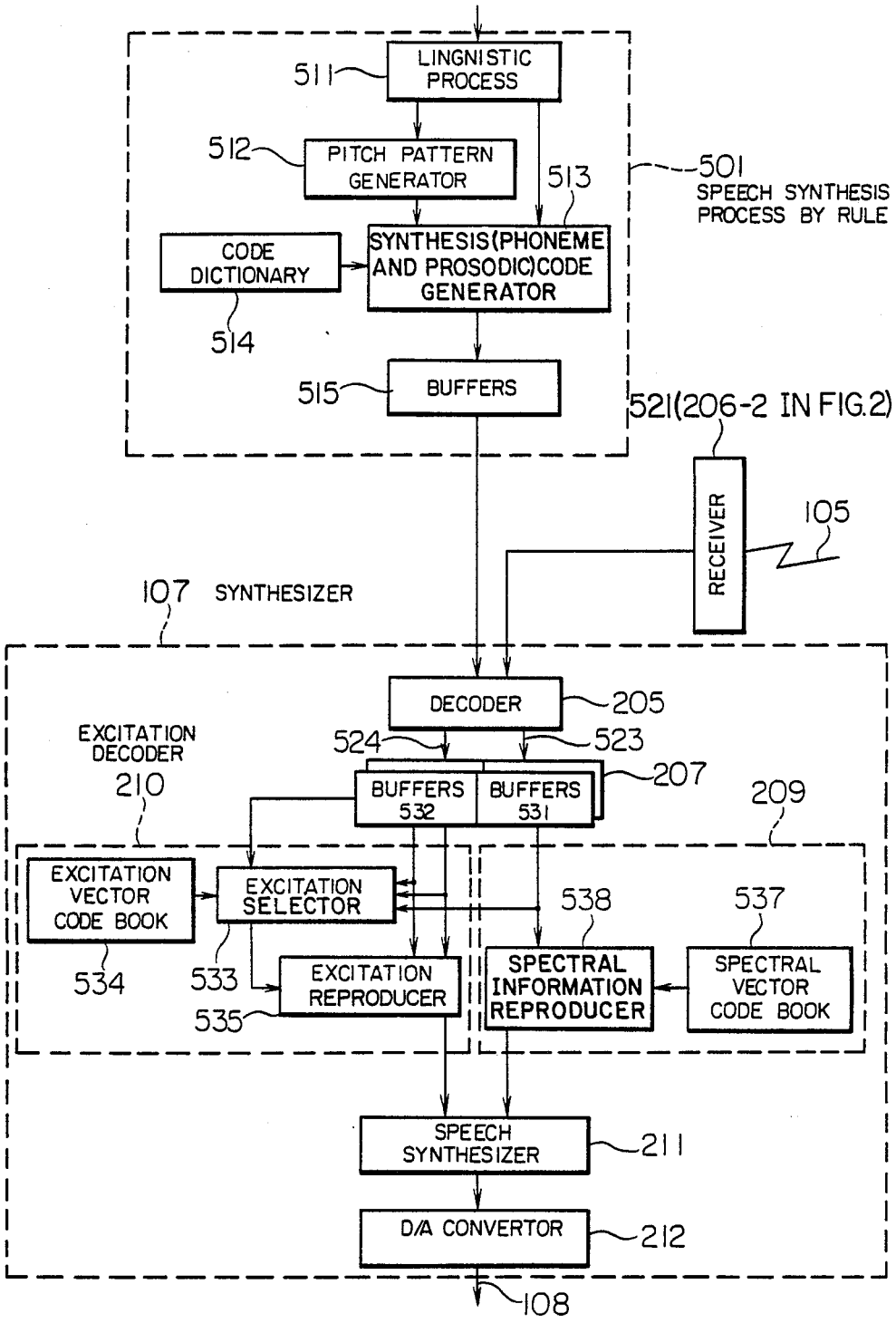
FIG. 5 shows an embodiment which integrates the high efficiency voice coding unit and a speech synthesis unit.

Referring to FIG. 5, a code received by a receiver 521 (206-2 in FIG. 2) is separated by the decoder 205 to a spectrum information code 523 and an excitation information code 524 and they are sent to buffers 531 and 532, respectively. The spectrum information vector code is supplied to an excitation selector 533 and a speech synthesizer 538, and the excitation information code is further separated to residual waveform vector code, pitch period code and residual amplitude code. The residual waveform vector code is supplied to the excitation (residual waveform) selector 533, the pitch period code is supplied to the excitation selector 533 and an excitation reproducer 535, and the residual amplitude code is supplied to the excitation reproducer 535.

The excitation selector 533 selects the excitation (residual) waveform to be used for the synthesis from a excitation vector code book 534 based on the spectrum vector code, residual waveform vector code and pitch period code, and sends it to the excitation reproducer 535. The excitation reproducer 535 converts the selected excitation waveform to a repetitive waveform by using the pitch period code, corrects the waveform amplitude by the residual amplitude code and reproduces a series of excitation waveforms, which are sent to the speech synthesizer 211.

A spectrum information reproducer 538 reads out the spectrum information to be used from the spectrum vector code book 537 based on the spectrum vector code and sets it into the synthesis filter 211 which reads in the reproduced excitation waveform from the excitation waveform reproducer 535 to synthesize the speech, which is produced as a synthesized/reproduced waveform 108 through the D/A converter 212.

The synthesis by rule unit 501 is now explained in connection with synthesis of a Japanese word. This processing is carried out by the synthesis by rule program in the main processor 201 of FIG. 2. Other language can be similarly processed by properly selecting a synthesis unit and language processing method.

The input character code sequence is converted to a pronounciation code sequence by a synthesis by rule linguistic processor 511 and it is time-segmented for assignment to accent and intonation. Specific procedures thereof are different from language to language and various procedures have been proposed for certain languages including Japanese and English. Since the procedure itself is not an essential part of the present invention, it is not explained here. Based on the time segmentation and the intonation and accent determined by the linguistic processor, the intonation pattern, particularly a pitch period pattern is generated by a pitch pattern generator 512. The generation procedure therefor can be realized by the generation model proposed by Fujisaki ("Analysis of Voice Fundamental Frequency Contours for Declarative Sentenses of Japanese" by H. Fujisaki et al, J. Acoustic. Soc. Jpn (E) S, 4 (1984) p 233).

The linguistic information and pitch pattern information thus produced are sent to a synthesis code generator 513. Inputs to the synthesis code generator 513 include the spectrum envelope information, pitch information and amplitude code necessary for the speech synthesis. The output thereof may be represented in the same form as the high efficiency coding system code. By preparing a data table which is used for the synthesis by rule, the synthesis unit can be shared as will be explained later.

Figures 6, 7:
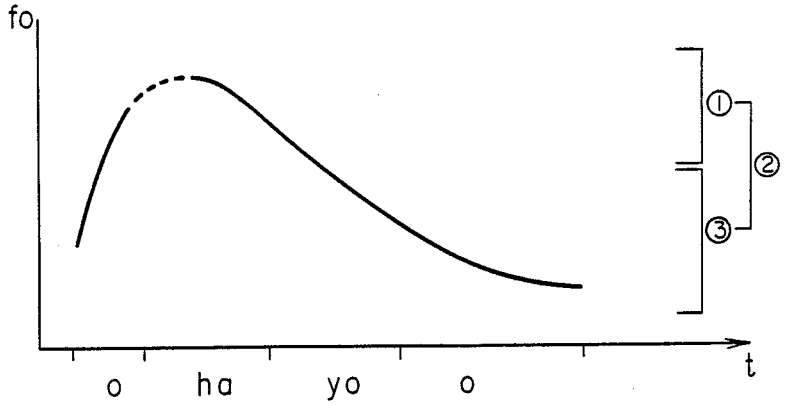
FIGS. 6 and 7 show configurations for speech synthesis.

In FIG. 6, in order to synthesize a Japanese word "ohayoo" (good morning), the synthesis units are "o", "ha", "yo" and "o" in accordance with syllables of the Japanese word, and they are time-segmented. In FIG. 6, an abscissa represents a time (t) and an ordinate represents a pitch frequency fo (Hz). When the synthesis code generator 513 receives the information shown in FIG. 6, it sequentially reads out codes having most closely matching characteristic to the input information from the synthesis by rule code dictionary, and sends them to a speech synthesis buffer 515 in the same form as the code of the high efficiency coding system. In order to simplify the explanation, the range of the pitch frequency is divided into three mutually overlapping regions as shown in FIG. 6. (The actual number of regions is larger depending on the quality of speech required.)

FIG. 7 shows a construction of the synthesis by rule code dictionary. Synthesis code sequences $a_{11}$, $a_{12}$, --- etc. can be argued by using synthesis units "a", "i", --- and the pitch period regions ①, ②, ③ as keys. Each synthesis code is recorded as a code sequence of a maximum anticipated length n ($n \times 10$ ms when control interval is 10 ms) for each control interval of the speech synthesizer. Each code consists of an excitation amplitude code A, a spectrum vector code P and ah excitation waveform vector code W. In FIG. 6, if the first synthesis unit "o" of the Japanese word "ohayoo" has a length of 120 ms, the pitch range belongs to ③ and $0_{3,1}$, $0_{3,2}$, --- $0_{3,12}$ ($120/10=12$) are read from the line ③, for "o" of the synthesis by rule code dictionary of FIG. 7 and they are sent to the speech synthesis buffer. The pitch code corresponding to ③ and the corresponding value in FIG. 6 is also sent out. Those codes are edited such that mutual positional relationship thereof is equal to that of the high efficiency voice coding system. In the present system, the excitation amplitude information is not selected directly from the synthesis by rule code dictionary but it may be modified by the synthesis code generator 513.

A high efficiency voice coding system suitable to a voice communication system in which the speech synthesis unit and the speech analysis unit are common with the speech recognition and speech synthesis by rule respectively is now explained.

The PARCOR system and the LSP system have been well known as the high efficiency voice coding system for less than 10 K bps and they have been practically used. However, the quality thereof is not sufficiently high to allow transmission of fine tone in order to permit distinction of a speaker. Approaches to resolve this problem have been proposed by multipulse method "A New Model of LPC Excitation for Producing Natural-Sounding Speech at Low Bit Rates" by B. S. Atal et al, Proc. ICASSP 82 S5. 10, 1982 and thinned-out method "A Speech Coding Method Using Thinned-out Residual" by A. Ichikawa et al, Proc. ICASSP 85, 25.7, 1985). In order to secure the desired quality of sound, information quantity of higher than a predetermined quantity (approximately 8 K bps) is necessary, and it is difficult to compress the speech data to 2–2.4 K bps which is adopted in the international data line.

Other method for largely compressing the speech information is a vector quantization method (for example, "Segment Quantization for Very-Low-Rate Speech Coding" by S. Roucos et al, Proc. ICASSP 82, p 1563). This method handles the data of lower than 1 K bps and lacks clearness of vocal sound. A combination of the multi-pulse method and the vector quantization has also been studied, but since the excitation information for determining the fine spectrum requires substantial amount of information even after it has been vector-coded, it is difficult under the present circumstance to transmit the speech signal having the quality of higher than 10 K bps with the information quantity of 2 K bps.

Since the speech is generated by a mouth having a physical restriction, physical characteristic thereof vary depending on the mouth. In the vector quantization method, a range of the speech is segmented, symbols are assigned to the sections, and the speech is transmitted by the symbols. In the LPC method, the speech is divided into the spectrum envelope information and the fine spectrum information and they are encoded and transmitted. In the receiving station, they are combined to reproduce the speech. It permits efficient compression of speech information and has been widely used. The spectrum envelope information is generally suitable to vector quantization. On the other hand, the fine spectrum information is close to white noise in characteristic and it is considered as the white noise and vector-coded for transmission. (For example, "A Stochastic Model of Excitation Source for Linear Prediction Speech Analysis-Synthesis" by G. Oyama et al, Pro. ICASSP 85, 25-2, 1985). The difficulty in compressing the information has been described above. (If the proposal by G. Oyama is converted to the information quantity, it is anticipated that only the fine spectrum information needs approximately 11.2 K bps.)

In the present system, it has been noticed that the envelope information and the fine spectrum information have a strong correlation therebetween, and the above problem is resolved by compressing the information by using the correlation.

It has been well known that the spectrum envelope information an the pitch frequency have a correlation therebetween. For example, a male has a larger body than a female and has a larger mouth for generating a voice. Accordingly, a formant frequency (resonance frequency of the mouth) of the male, which is the spectrum envelope information, is usually lower than that of the female. On the other hand, the pitch frequency of the voice of the male is lower than that of the female. This has been experimentarily proved. (For example, "Oral perception Sense and Speech" edited by Miura, p 355, published by Association of Electronics and Electrical Communication of Japan, 1980.)

It has also been known that there is a high correlation between the pitch frequency and the excitation amplitude. (For example, "Generation of Pitch Quanta by Amplitude Information" by Suzuki et al, p 647, Papers of Japan Acoustic Association, May 1980). The present system provides a new system for compressing the information by utilizing such correlations.

The speech to be transmitted is converted to a vector symbol sequence by vector-quantizing the spectrum envelope information. Then, the fine spectrum information is extracted only from vectors of those fine spectrum information which have high correlation to the symbols. Thus, a range of the fine spectrum vector is specified by the spectrum envelope vector instead of selecting the vector from the entire possible range of the fine spectrum vectors, and they among the specified vector the fine spectrum vector is specified, so that the information quantity can be significantly reduced. In the fine spectrum information, the information can be compressed by hierarchally coding the information by utilizing the correlations between the pitch frequency, and the excitation amplitude and the residual excitation waveform.

A specific embodiment of the present system is explained with reference to FIGS. 8 and 9.

In the present system, the spectrum envelope information is the linear prediction coefficient and the fine spectrum information is the prediction residual waveform, although the present system is not limited to the above combination.

Figure 8:
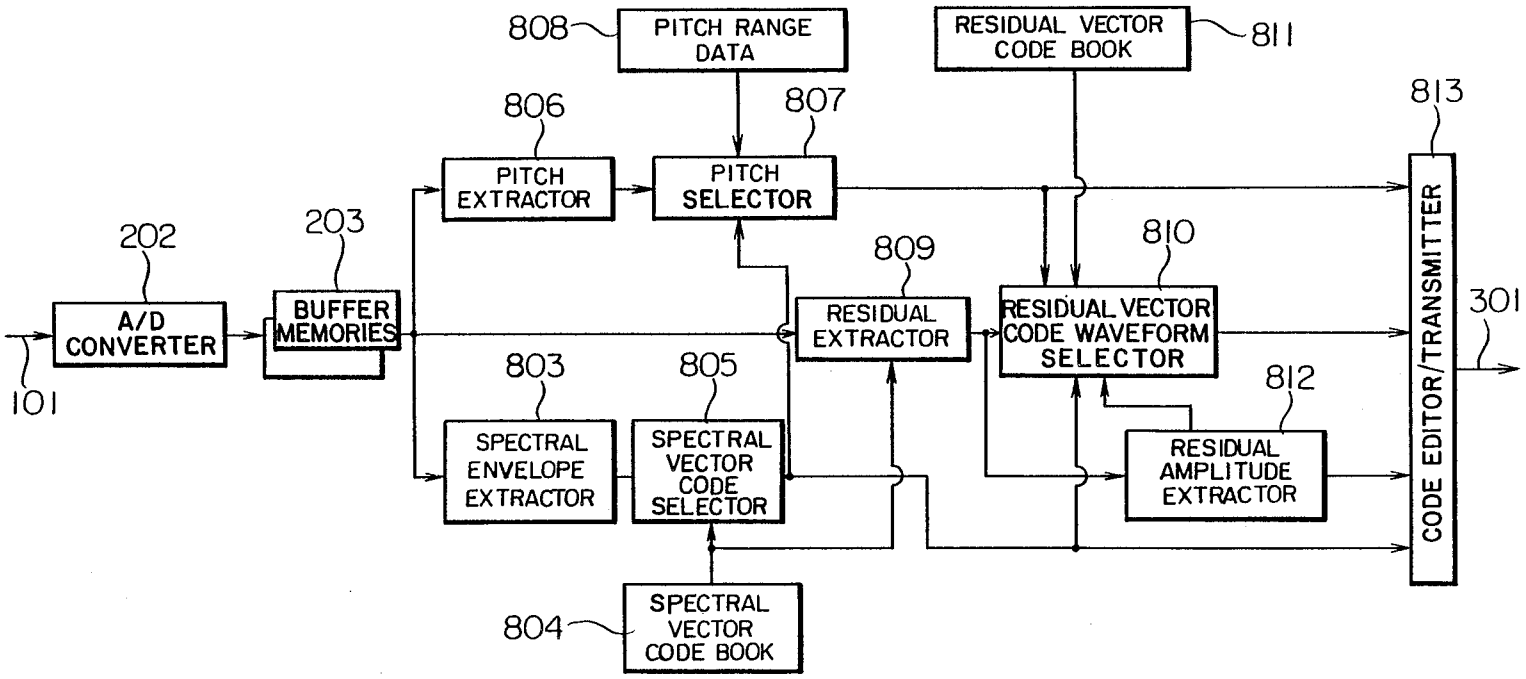
FIGS. 8 and 9 show coding unit and decoding unit of the high efficiency voice coding unit.

FIG. 8 illustrates the procedure of the high frequency voice coding unit. The elements of the present procedure correspond to the elements of FIG. 2 as follows.

The speech input 101, A/D converter 202 and buffer 203 are common to both figures. A spectrum extractor 803, a pitch extractor 806 and a residual waveform extractor 809 of FIG. 8 correspond to the spectrum analyzer 204-1, predictive residual analyzer 204-2 and the pitch extractor 204-3 in the DSP 204 of FIG. 2. The processing in a residual amplitude extractor 812 is carried out by the software in the DSP 204. The processings of a spectrum vector code book 804 and a spectrum vector selector 805, a pitch range data memory 808 and a pitch selector 407, and a residual waveform vector code book 411 and a residual waveform code selector 410 correspond to the processings of the vector code book 208-2 and the matching unit 208-1 of the vector quantizer 208 of FIG. 2. The processing steps of the elements are controlled by a program in the processor of the control unit 201.

The processing steps of FIG. 8 are explained below.

In FIG. 8, the speech input 101 is digitized by the A/D converter 202 and it is sent to the input buffer 203. The buffer 203 is of two-side structure so that it can hold the next speech input without interruption during the encoding of the current input speech. The speech signal in the buffer is fetched for each section and sent to the spectrum vector code selector 805, pitch extractor 806, and residual waveform extractor 809.

The spectrum vector code selector 805 makes the linear prediction analysis in a well-known method and sequentially compares the resulting prediction coefficient to the spectrum information in the spectrum vector code book 804 to select the spectrum having a highest likelihood. This step can be carried out by a conventional speech recognition unit.

The selected spectrum vector code is sent to the pitch selector 807 and the code editor/transmittor 813, and the corresponding spectrum information is sent to the residual waveform extractor 809.

The pitch extractor 806 may be constructed by well-known AMDF method or auto-correlation method.

The pitch selector 807 fetches the pitch range designated by the spectrum vector code from the pitch range data memory 808, selects a pitch frequency from the pitch candidates produced by the pitch extractor 806 by the software of the control unit 201 (FIG. 2), and sends it to the code editor/transmittor 813 and a residual waveform vector code selector 810.

The residual waveform extractor 809 comprises a conventional linear prediction type inverse filter, and it fetches the spectrum information corresponding to the code selected by the spectrum vector code selector, from the spectrum vector code book and sets it into the inverse filter, and receives the corresponding input speech waveform stored in the buffer 203 to extract the residual waveform. The spectrum information produced by the spectrum extractor 803 may be used in this step. The extracted residual waveform is sent to the residual waveform vector code selector 810 and a residual amplitude extractor 812. The residual amplitude extractor 812 produces the average output of the residual waveform and sends it to the residual waveform vector code selector 810 and the code editor/transmitter 813.

The residual waveform vector code selector 810 fetches the candidate residual waveform vector from a residual waveform vector code book 811 based on the spectrum vector code and the pitch frequency, and compares it with the residual waveform sent from the residual waveform extractor 809 to determine the most matching residual waveform vector code. In order to compare those, the amplitude of the residual amplitude information is normalized. The selected residual waveform vector code is sent to the code editor/transmitter 813.

The code editor/transmitter 813 edits the spectrum vector code, residual waveform vector code, pitch period code and residual amplitude code and sends them as the encoded speech signal 301. This processing is carried out by the transmitter 206-1 of the line interface 206 of FIG. 2.

Figure 9:
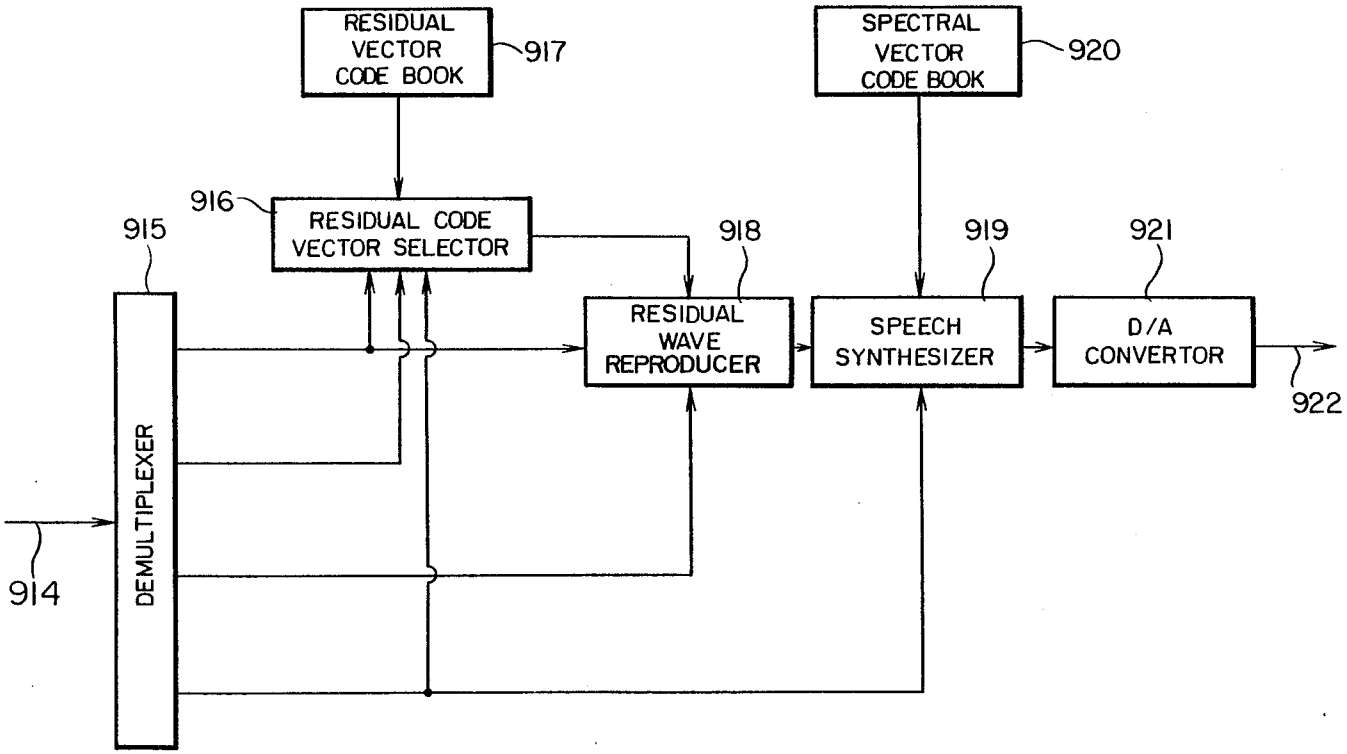

Referring to FIG. 9, the procedure of the high efficiency voice decoder is explained.

In FIG. 9, the code sent from a transmission line 914 is received by a received code demultiplexer 915 which demultiplexes it to spectrum vector code, residual waveform vector code, pitch period code and residual amplitude code.

The spectrum vector code is sent to a residual waveform code vector selector 916 and a speech synthesizer 919, the residual waveform vector code is sent to a residual waveform code vector selector 916, the pitch period code is sent to the residual waveform code vector selector 916 and a residual waveform reproducer 918, and the residual amplitude code is sent to the residual waveform reproducer 918.

The residual code vector selector 916 selects the residual waveform from the residual vector code book 917 based on the spectrum vector code, residual vector code and pitch period code, and sends it to the residual waveform reproducer 918. The residual waveform reproducer 918 converts the selected residual vector code to a repetitive waveform by using the pitch period code, corrects the amplitude by the residual amplitude code and reproduces a series of residual waveform, which is sent to the speech synthesizer 919.

The speech synthesizer 919 reads out the spectrum vector to be used from the spectrum vector code book 920 based on the spectrum vector code, sets it into the internal synthesis filter, and receives the reproduced residual vector code to synthesize the speech. The speech synthesis filter may be a conventional LPC type speech synthesis filter for RELP.

The synthesized speech waveform is converted by the D/A converter 921 to an analog signal to reproduce a speech signal 922.

By registering a tone signal in the spectrum vector code book, a signal other than speech can be transmitted.

In accordance with the present system, very high quality of speech can be encoded with small information quantity.

Since the processing in the receiving unit when the character code has been transmitted is different from that when the speech signal has been high efficiency coded and transmitted, it is necessary to transmit them distinctively. Such distinction may be attained in the following manner. In the following description, the teletex network is used as the transmission network.

In the teletex, not all of the codes correspond to characters but certain codes are not used. These codes are used as control codes for speech codes. In FIG. 2, a command to transmit the speech signal is issued by the processor 201 (which also functions as the controller) to the transmitter 206-1 in the line interface unit 206. The transmitter 206-1 adds the control code and the number of codes (for example, 1024 words) to be used for the transmission of the speech signal to the head of the codes and transmits the high efficiency coded speech codes by the number equal to said number of codes. After the designated number of codes have been transmitted, the transmitter returns to the character code transmission mode. When the speech signal is to be continuously transmitted, the above operation is repeated. The receiver 206-2 of the interface unit 206 is normally in the character code reception mode. If the received code is the speech transmission code, the code to be used for the subsequent speech transmission is decoded and it is assumed that the speech codes have been received by the number of codes. It is reported to the processor 201 and the received data is written into the synthesizer 107 or the memory 109 at the address assigned for the voice mail. After the designated number of codes have been received, the receiver returns to the character code reception mode. Other transmission control is same as that of the teletex. This arrangement permits teletex communication by the standard teletex terminal.

We claim:

1. Character and voice communication system comprising:

(1) voice encoding means including means for receiving a speech signal, speech analysis means for analyzing the speech signal to produce spectrum envelope information and fine spectrum information and encoding means for encoding said spectrum envelope information and said fine spectrum information, said speech analysis means being used for both speech transmission and speech recognition;

(2) speech recognition means for recognizing said speech signal using said spectrum envelope information and converting a result of said recognition into character code strings;

(3) keyboard means for inputting characters and converting said characters into character code strings;

(4) reception and transmission means for receiving and transmitting said encoded spectrum envelope information and said fine spectrum information and either said character code strings from said speech recognition means or said character code strings from said keyboard means;

(5) voice decoding means including decoding means for decoding said encoded spectrum envelope information and said encoded fine spectrum information received by said reception and transmission means, text-to-speech rule means for converting said character code strings from said speech recognition means or said keyboard means into spectrum envelope information and fine spectrum information in accordance with a predetermined rule, and speech synthesis means for synthesizing a speech signal using said decoded spectrum envelope information and said decoded fine spectrum information from said decoding means or said spectrum envelope information or fine spectrum information from said text-to-speech rule means.

2. A character and voice communication system according to claim 1 wherein said reception and transmission means includes means for distinctively transmitting and receiving said information and said character code strings.

3. A character and voice communication system according to claim 1, wherein said speech synthesis means of said voice decoding means includes speech synthesis rule means for converting said character code strings to a speech signal.

4. A character and voice communication system according to claim 1 wherein said speech analysis means of said voice encoding means includes means for separating said speech signal into spectrum envelope information and fine spectrum information, said voice encoding means further includes vector quantization means for producing code information to classify the spectrums envelope information into a limited number of patterns and means for encoding the fine spectrum information, wherein said means for encoding the fine spectrum information is controlled by the code information produced by said vector quantization means.

5. A character and voice communication system according to claim 4 wherein said means for encoding the fine spectrum information controls a range of pitch variation and type of excitation waveform and a range or excitation wave form amplitude using the code information produced by said vector quantization means.

6. A character and voice communication system according to claim 1 wherein said voice decoding means includes spectrum envelope decoding means and fine spectrum fine decoding means.

7. A character and voice communication system according to claim 1 further comprising means for synthesizing a speech signal using the output from said speech recognition means.

8. A character and voice communication system according to claim 1 further comprising means for displaying the signal converted by said speech recognition means.

* * * * *